US006042030A

United States Patent [19]

Howe et al.

[11] Patent Number: 6,042,030

[45] Date of Patent: Mar. 28, 2000

[54] SAFE CHARGING WITH NON-INSULATIVE ATOMIZER

[76] Inventors: Varce E. Howe, 12102 Daugherty Dr., Zionsville, Ind. 46077; David R. Huff, 174 White Heron Dr. P.O. Box 2445, Santa Rosa Beach, Fla. 32459

[21] Appl. No.: 09/046,383

[22] Filed: Mar. 23, 1998

[51] Int. Cl.[7] ..... B05B 5/04

[52] U.S. Cl. ..... 239/703; 239/223; 239/288.5; 239/691

[58] Field of Search ..... 239/223, 224, 239/691, 703–708, 3, 288, 288.3, 288.5

[56] References Cited

U.S. PATENT DOCUMENTS

| | | | |
|---|---|---|---|
| 2,659,841 | 11/1953 | Hampe | 239/704 |
| 2,784,114 | 3/1957 | Miller | 239/223 X |
| 3,155,539 | 11/1964 | Juvinall . | |
| 3,815,820 | 6/1974 | Probst . | |
| 4,148,932 | 4/1979 | Tada et al. . | |
| 4,275,838 | 6/1981 | Fangmeyer . | |
| 4,331,299 | 5/1982 | Culbertson et al. | 239/691 |
| 4,381,079 | 4/1983 | Allen . | |
| 4,447,008 | 5/1984 | Allen . | |
| 4,508,266 | 4/1985 | Saito et al. . | |
| 4,516,521 | 5/1985 | Szelagowski et al. | 239/288 X |
| 4,887,770 | 12/1989 | Wacker et al. . | |
| 5,078,321 | 1/1992 | Davis et al. . | |
| 5,137,215 | 8/1992 | Degli . | |
| 5,433,387 | 7/1995 | Howe et al. . | |
| 5,622,563 | 4/1997 | Howe et al. . | |
| 5,632,448 | 5/1997 | Alexander et al. . | |
| 5,633,306 | 5/1997 | Howe et al. . | |
| 5,662,278 | 9/1997 | Howe et al. . | |

FOREIGN PATENT DOCUMENTS

| | | | |
|---|---|---|---|
| 292679 | 11/1988 | European Pat. Off. | 239/691 |

OTHER PUBLICATIONS

Test and Judgement of Ignition Hazards Caused by Electrostatic Spray Guns and Charged Surfaces Without the Use of Explosive Mixtures, E. Heidelberg, Journal of Electrostatics, 21 (1988), pp. 1–17.

Approval Standard Factory Mutual Research Corporation, Electrostatic Finishing Equipment Class Number 7260, Mar. 1996.

NFPA 33 Standard for Spray Application Using Flammable or Combustible Materials, 1995 Edition, National Fire Protection Association.

*Primary Examiner*—Kevin Weldon
*Attorney, Agent, or Firm*—Barnes & Thornburg

[57] ABSTRACT

An electrically non-insulative, typically metal, atomizer bell is housed in a shroud-like housing. A prime mover, such as an air turbine motor, typically also housed in the housing, rotates the bell to atomize coating material delivered to the bell. A second shroud movable relative to the bell has a first, retracted orientation in which the second shroud does not shield the charging portion from the approach of articles to the bell and a second, projected orientation in which the second shroud does shield the bell from the approach of articles to reduce the likelihood of disruptive electrical discharges from the bell.

34 Claims, 3 Drawing Sheets

SAFE CHARGING WITH NON-INSULATIVE ATOMIZER

BACKGROUND OF THE INVENTION

This invention relates to electrostatically aided atomization and coating of articles with charged particles. It is disclosed in the context of certain types of coating material dispensers. However, it is believed to be useful in a wide range of coating dispensing applications. As used in this application, terms such as "electrically conductive" and "electrically non-insulative" refer to a broad range of conductivities electrically more conductive than materials described as "electrically non-conductive" and "electrically insulative." Terms such as "electrically semiconductive" refer to a broad range of conductivities between electrically conductive and electrically non-conductive.

In its early years, the field of electrostatically aided coating material atomization and dispensing was dominated by the dispensing of coating materials containing organic solvents. These solvents and the coating materials they carried typically were electrically non-conductive or only very slightly conductive, but the carriers or solvents were also relatively volatile. The particles of these coating materials thus could ordinarily be charged by contact with, or at least passage within relatively short distances of, electrodes maintained at relatively high magnitude potentials with respect to the article(s) to be coated by the atomized coating material particles. However, care needed to be taken not to stimulate high energy electrical discharge across the space between the electrodes and the article(s) being coated. This need dictated considerable attention by operators of such equipment. The volatility of these solvents also raised environmental concerns about the release of so-called voc's (volatile organic compounds).

Efforts have continued to enhance solvent based coating systems, both against the hazards associated with having relatively high magnitude electrical potentials across atmospheres containing voc's, and against the inevitable close proximity of operators to the highly charged electrodes of such equipment. Standards for testing such equipment have been promulgated by a number of testing agencies in various countries. Illustrative of such standards is the Electrostatic Finishing Equipment Approval Standard, Class Number 7260, promulgated by Factory Mutual Research Corporation (the FM standard).

FM standard includes protocols for the testing of both manual equipment (for example, hand held coating atomizing and dispensing guns—the FM standard, section 5) and automatic equipment (for example, atomizers mounted on robot arms—the FM standard, section 6). Among the tests in both cases is a test in which the equipment at operating voltage is probed using a grounded metal sphere having a diameter of one inch (about 2.5 cm). This test takes place in an explosive atmosphere of propane in air. An explosion is a failed test. To achieve FM approval, the equipment must, inter alia, pass this test. Such standards have caused considerable research and improvement in the safety of electrostatic coating systems. Some ways in which the protocols can be addressed are illustrated and described in co-pending U.S. Ser. No. 08/955,039 filed Oct. 21, 1997, titled SAFE CHARGING, and assigned to the same assignee as this application. Other ways also exist. Many of these ways involve the use of electrically non-conductive rotary atomizers. However, many coating applicators prefer electrically conductive, and specifically, metal, rotary atomizers, for example, for their cost, their durability, their ability to transfer charge from the atomizer's connection to a high-magnitude electrostatic potential supply to the atomizer's rotary edge from which the coating material is atomized and dispensed in a cloud toward the article(s) to be coated, and so on. It has been a significant and ongoing challenge of the atomizer industry to address the coating applicators' competing concern for safety and desire for metal rotary atomizers.

This application addresses primarily automatic coating equipment of the type covered by, inter alia, section 6 of the standard, and primarily automatic coating equipment equipped with metal atomizers. One of the tests automatic coating equipment must pass to achieve FM listing is detailed in section 6.3.2.3 of the FM standard. In that test, the automatic protection incorporated into an electrostatic power supply which is to be used to charge the automatic coating equipment is set to its least sensitive position, that is, the position offering the least protection against disruptive electrical discharge. Then, the power supply is cycled off and on while a grounded test probe is maintained at a predetermined spacing from the equipment. This application addresses apparatus to aid metal atomizer-equipped automatic coating equipment in meeting the requirements of section 6.3.2.3 of the FM standard.

DISCLOSURE OF THE INVENTION

The invention contemplates, in combination, an atomizer having an electrically non-insulative charging portion, an atomizer housing, a selectively movable shroud, and a first prime mover for selectively moving the movable shroud relative to the charging portion. The shroud has a first, retracted orientation in which the shroud does not shield the charging portion from the approach of articles to the charging portion. In this retracted orientation of the shroud the atomizer dispenses coating material. The shroud further has a second, projected orientation in which the shroud shields the charging portion from the approach of articles to the charging portion.

According to an illustrative embodiment, the atomizer housing lies generally between the atomizer and the shroud. The atomizer housing comprises an outer surface and the shroud comprises an inner surface having a generally complementary configuration to the outer surface.

Illustratively, the atomizer housing comprises a first opening through which the atomizer dispenses coating material and the shroud comprises a corresponding second opening through which the atomizer dispenses coating material. The second opening generally surrounds the first when the shroud is in the first orientation.

Further illustratively, the shroud comprises at least one member for projecting into an interfering orientation generally obstructing the second opening when the shroud is in the second orientation. The at least one member retracts from the interfering orientation when the shroud is in the first orientation.

Additionally illustratively, the at least one member comprises a plurality of members disposed about the perimeter of the second opening. Further means are provided for urging the plurality of member generally into interfering orientation in the second opening when the shroud is in the second orientation.

Illustratively, the urging means comprises a plurality of springs for yieldably urging the plurality of members generally into interfering orientation in the second opening. The springs yield to interference between the housing and the shroud as the shroud moves from the second orientation to the first to permit withdrawal of the plurality of members from interfering orientation in the second opening as the shroud moves from the second orientation toward the first orientation.

Further illustratively, a plurality of actuators are provided. One actuator cooperates with each respective member and a corresponding spring to actuate the respective member to move from interfering orientation in the second opening.

According to another embodiment, the shroud lies generally between the atomizer and the atomizer housing.

Illustratively, the atomizer housing comprises a first opening through which the atomizer dispenses coating material and the shroud comprises a corresponding second opening through which the atomizer dispenses coating material. The first opening generally surrounds the second when the shroud is in the first orientation.

Further illustratively, the shroud comprises a shroud inner wall and a shroud outer wall. At least one passageway extends generally in a non-intersecting orientation to the shroud inner and outer walls. At least one resistance is disposed in the at least one passageway. The at least one resistance has first and second terminals. The first and second terminals are exposed from the shroud respectively at a forward end of the shroud and along the shroud inner wall adjacent the location of the atomizer when the shroud is in the second orientation.

Additionally illustratively, the at least one resistance comprises at least one lumped resistor.

Illustratively, the at least one resistance comprises electrically non-insulative material provided in the at least one passageway.

Additionally illustratively, the atomizer comprises a rotary atomizer. A second prime mover is provided for rotating the rotary atomizer to promote the dispensing of the coating material therefrom.

Further illustratively, the atomizer comprises a metal atomizer.

Illustratively, the first prime mover comprises a linear fluid motor such as a fluid piston and cylinder.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
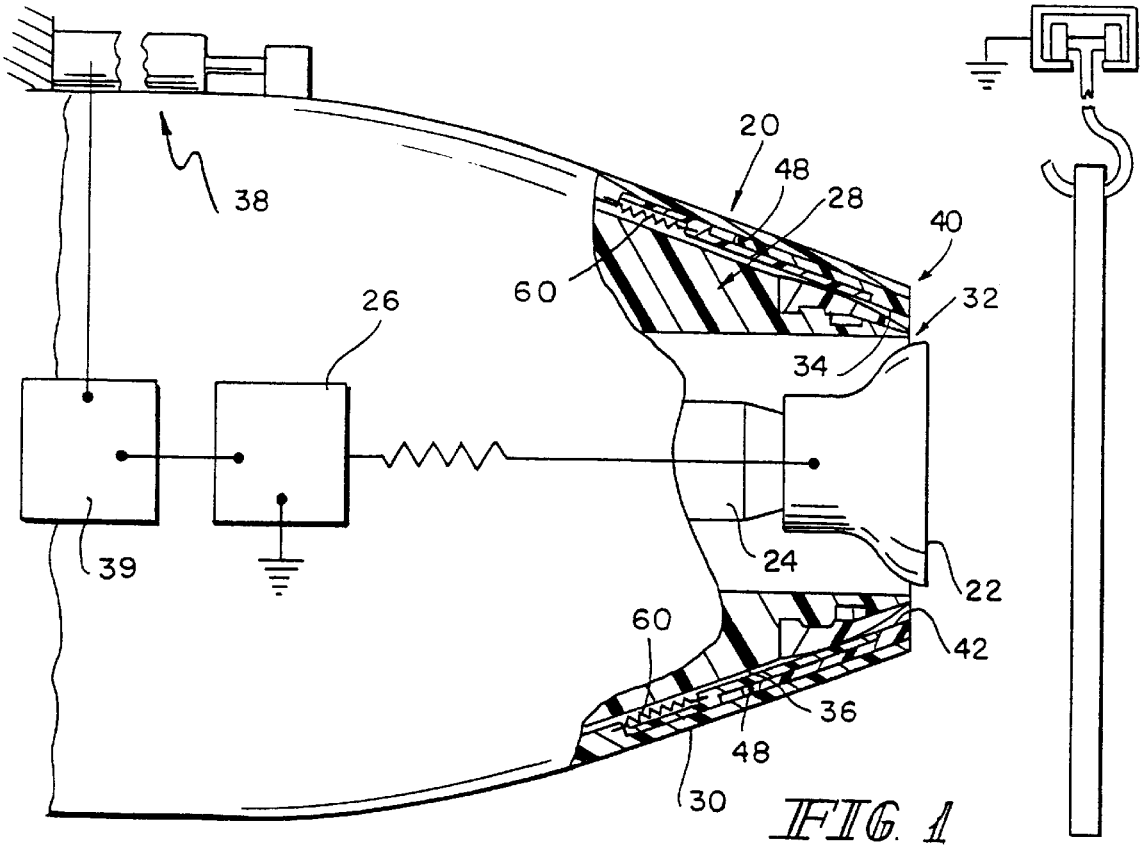
FIG. 1 illustrates a partly diagrammatic, partly broken away side elevational view of a device constructed according to the present invention in a first orientation.
Figure 2:
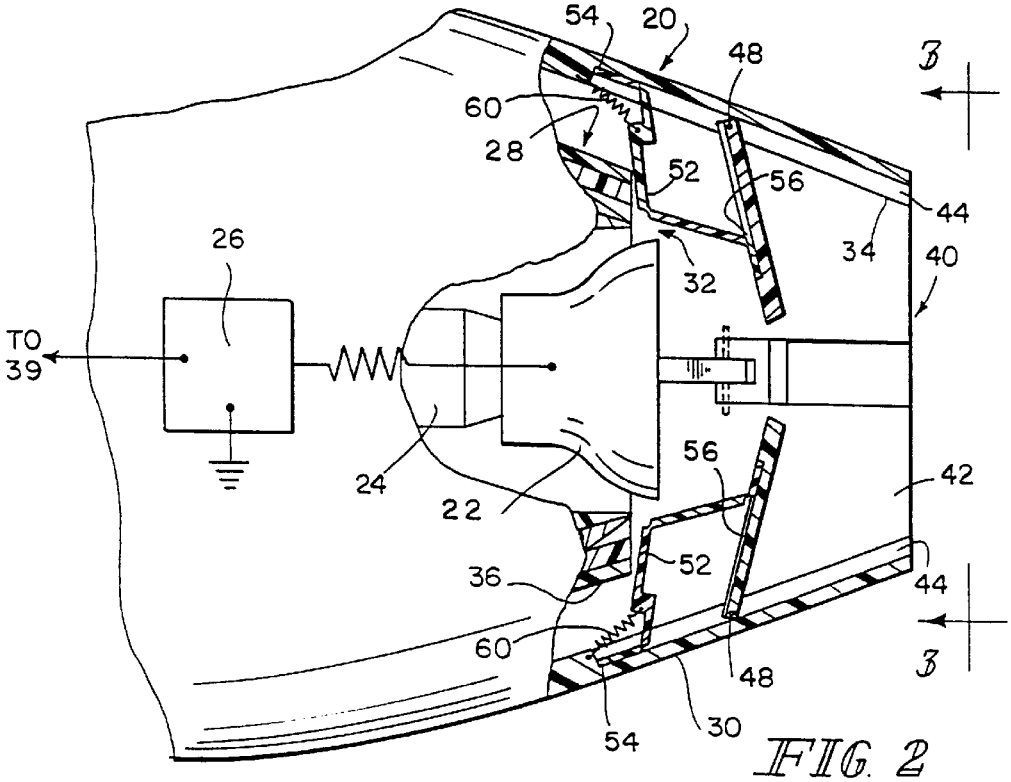
FIG. 2 illustrates a partly diagrammatic, partly broken away side elevational view of the device illustrated in FIG. 1 in a second orientation.
Figure 3:
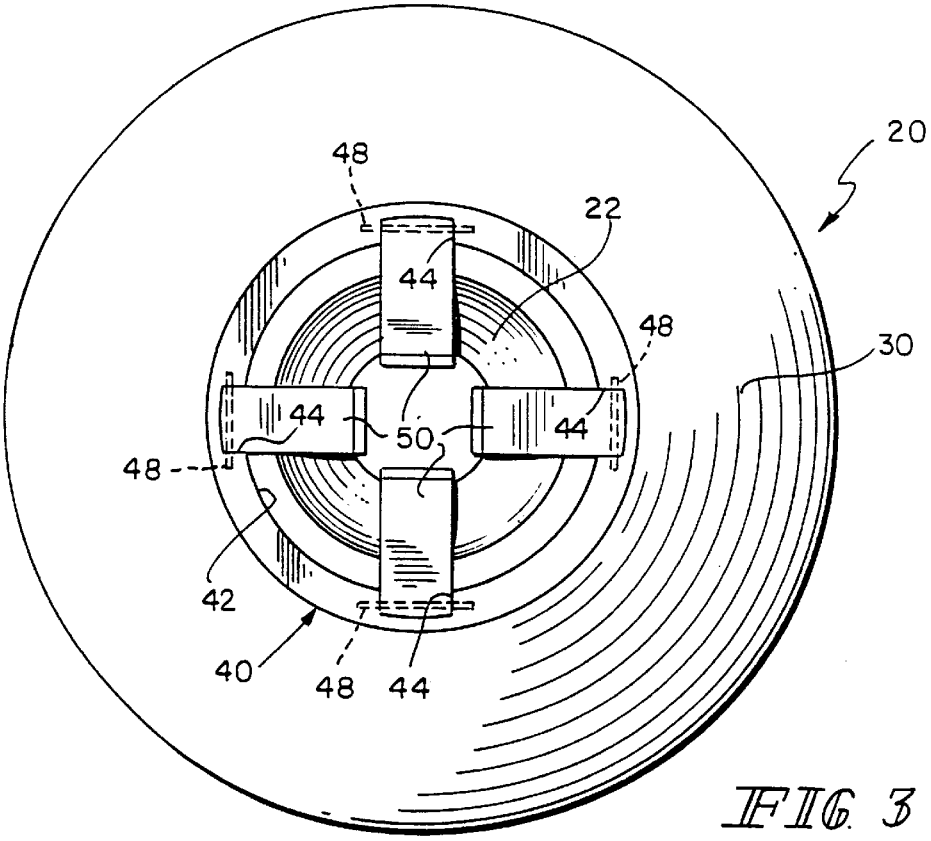
FIG. 3 illustrates a fragmentary sectional view of the device illustrated in FIGS. 1–2 in the orientation illustrated in FIG. 2, taken generally along section lines 3—3 of FIG. 2.

Referring now to FIGS. 1–3, an atomizer head 20 includes a somewhat cup- or bell-shaped metal atomizer 22 of the type described in, for example, U.S. Pat. No. 4,148,932. Atomizer 22 is typically rotated by a motor 24 of the general type described in, for example, U.S. Pat. Nos. 4,275,838; 5,433,387; or 5,622,563, and is maintained at relatively high-magnitude electrostatic potential by a power supply 26 such as, for example, the Micropak™ power supply available from ITW Ransburg, 1810 North Wayne, Angola, Ind. 46703. Atomizer 22 typically is surrounded by a shroud 28 of the general type, and for the purposes, described in, for example, U.S. Pat. Nos. 5,433,387 and 5,622,563. Another, outer, shroud 30 surrounds particularly the forwardmost portion 32 of shroud 28 and has an inner contour 34 which is more or less complementary in configuration to the outer contour 36 of shroud 28 when shroud 30 is in its orientation illustrated in FIG. 1.

Outer shroud 30 is selectively movable between its projected or deployed orientation illustrated in FIG. 2 and its retracted or undeployed orientation illustrated in FIG. 1 by any suitable prime mover(s) 38, linear fluid piston and cylinder motors being illustrated as in U.S. Pat. No. 3,155,539. An interlock 39, illustrated diagrammatically, is provided between power supply 26 and the prime mover(s) 38 so that when the power supply is turned off, the prime mover(s) 38 project(s) outer shroud 30 to its orientation illustrated in FIG. 2, and after the power supply 26 is turned on and had time to reach steady state operation, the prime mover(s) 38 retract(s) the outer shroud 30 to its position illustrated in FIG. 1, permitting coating operations to be conducted by atomizer 22. At the forward end 40 of outer shroud 30, adjacent the opening 42 in shroud 30 through which coating material atomized from atomizer 22 is discharged toward an article 43 to be coated thereby when shroud 30 is in its position illustrated in FIG. 1, the inner contour 34 of shroud 30 is provided with a number, illustratively four, of grooves 44. Each groove 44 pivotally 48 mounts a retractable finger or flap 50 constructed from, for example, electrically non-conductive resin.

A hinge 52, for example, a flexible, electrically non-conductive resin material formed with one or more, illustratively two, so-called living hinges, is coupled between a rearward portion 54 of each groove 44 and a forward portion of a respective groove 56 formed on the inner surface of each flap 50. The hinges 52 are biased by, for example, respective electrically non-conductive resin coil tension springs 60, into the orientations illustrated in FIG. 2 which correspond to the deployed or projected orientations of flaps 50 out of their respective grooves 44 radially toward the center of opening 42 and into interfering relationship with anything being placed into opening 42. When outer shroud 30 is retracted rearwardly, the interference of the hinges 52 with the front end 64 of inner shroud 28 adjacent the opening 66 therein through which coating material is discharged from atomizer 22 causes the flaps 50 to retract from their deployed orientations illustrated in FIGS. 2–3 to their undeployed orientations illustrated in FIG. 1 so that coating material can be dispensed. The interlock 39 between power supply 26 and prime mover(s) 38 and the flaps 50 aid the equipment illustrated in FIGS. 1–3 in addressing the requirements of section 6.3.2.3 of the FM standard.

Figure 6:
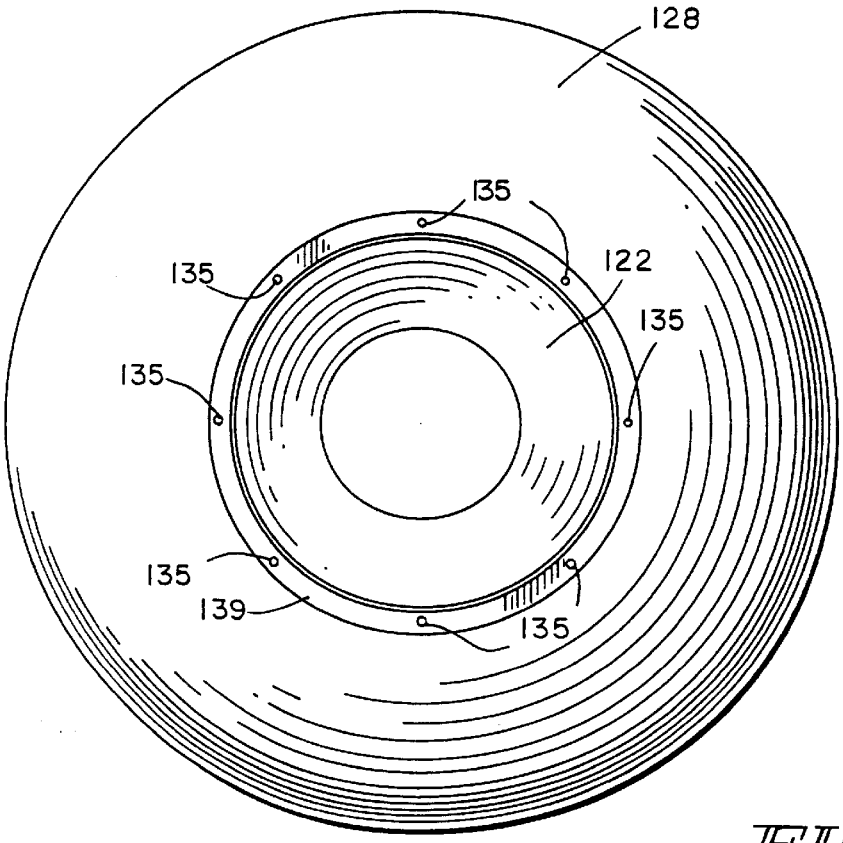
Figure 4:
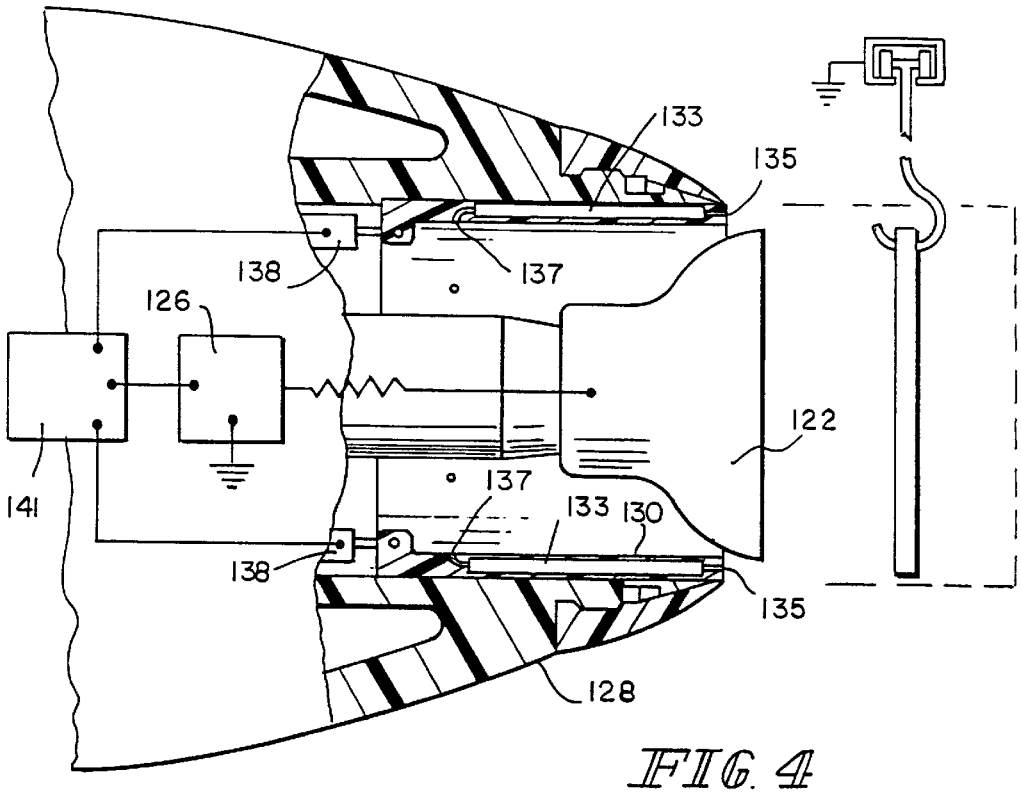
FIG. 4 illustrates a partly diagrammatic, partly broken away side elevational view of another device constructed according to the present invention in a first orientation.
Figure 5:
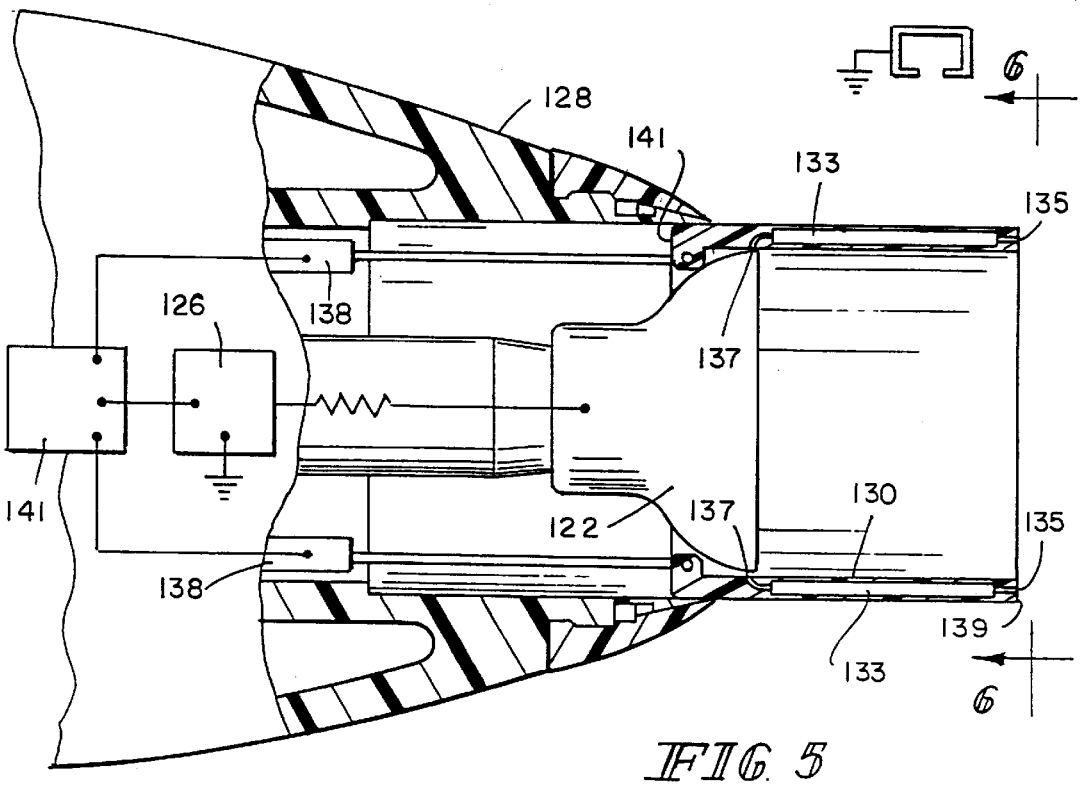
FIG. 5 illustrates a partly diagrammatic, partly broken away side elevational view of the device illustrated in FIG. 4 in a second orientation; and, FIG. 6 illustrates a fragmentary sectional view of the device illustrated in FIGS. 4–5 in the orientation illustrated in FIG. 5, taken generally along section lines 6—6 of FIG. 5.

In another embodiment of the invention illustrated in FIGS. 4–6, an atomizer 122 is housed within a shroud 128. Another cylindrical, sleeve-like shroud 130 has a retracted, or undeployed, orientation illustrated in FIG. 4 and a projected, or deployed, orientation illustrated in FIG. 5. Shroud 130 is selectively movable between its projected or deployed orientation illustrated in FIG. 5 and its retracted or undeployed orientation illustrated in FIG. 4 by any suitable prime mover(s) 138, linear fluid piston and cylinder motors as in U.S. Pat. No. 3,155,539 again being illustrated. Again, an interlock 141 between a power supply 126 and prime mover(s) 138 is illustrated diagrammatically. Interlock 141 is provided between power supply 126 and the prime mover(s) 138 so that when the power supply 126 is turned off, the prime mover(s) 138 project(s) shroud 130 to its orientation illustrated in FIG. 5, and after the power supply 126 is turned on and has had time to reach steady state operation, the prime mover(s) 138 retract(s) the shroud 130 to its position illustrated in FIG. 4. When shroud 130 is retracted rearwardly, atomizer 122 is exposed so that coating material can be dispensed. When shroud 130 is projected forwardly, atomizer 122 is shielded somewhat from the approach of grounded articles toward it which might otherwise cause disruptive electrical discharges from atomizer 122 and/or other equipment housed within shroud 128.

Additionally, resistances 133 having exposed terminals 135, 137 adjacent the end 139 of shroud 130 and atomizer 122 when shroud 130 is in its projected orientation may be added for the purposes described in U.S. Ser. No. 08/955,039, the disclosure of which is incorporated herein by reference. The interlock 141 between power supply 126 and prime mover(s) 138 aid the equipment illustrated in FIGS. 4–6 in addressing the requirements of section 6.3.2.3 of the FM standard.

What is claimed is:

1. In combination, an atomizer having an electrically non-insulative charging portion, an atomizer housing, a selectively movable shroud, and a first prime mover for selectively moving the movable shroud relative to the charging portion, the shroud having a first, retracted orientation in which the shroud does not shield the charging portion from the approach of articles to the charging portion, in which retracted orientation of the shroud the atomizer dispenses coating material, the shroud further having a second, projected orientation in which the shroud shields the charging portion from the approach of articles to the charging portion, the shroud further comprising at least one member for projecting into an interfering orientation generally obstructing the second opening when the shroud is in the second orientation, the at least one member retracting from the interfering orientation when the shroud is in the first orientation.

2. The combination of claim 1 wherein the atomizer housing lies generally between the atomizer and the shroud, the atomizer housing comprising an outer surface and the shroud comprising an inner surface having a generally complementary configuration to the outer surface.

3. The combination of claim 2 further comprising means for urging the at least one member generally into interfering orientation in the second opening when the shroud is in the second orientation.

4. The combination of claim 3 wherein the urging means comprises a spring for yieldably urging the member generally into interfering orientation in the second opening, the spring yielding to interference between the housing and the shroud as the shroud moves from the second orientation to the first to permit withdrawal of the member from interfering orientation in the second opening as the shroud moves from the second orientation toward the first orientation.

5. The combination of claim 4 further comprising an actuator cooperating with the member and the spring to actuate the member to move from interfering orientation in the second opening.

6. The combination of claim 2 wherein the atomizer housing comprises a first opening through which the atomizer dispenses coating material and the shroud comprises a corresponding second opening through which the atomizer dispenses coating material, the second opening generally surrounding the first when the shroud is in the first orientation.

7. The combination of claim 6 further comprising means for urging the at least one member generally into interfering orientation in the second opening when the shroud is in the second orientation.

8. The combination of claim 7 wherein the urging means comprises a spring for yieldably urging the member generally into interfering orientation in the second opening, the spring yielding to interference between the housing and the shroud as the shroud moves from the second orientation to the first to permit withdrawal of the member from interfering orientation in the second opening as the shroud moves from the second orientation toward the first orientation.

9. The combination of claim 8 further comprising an actuator cooperating with the member and the spring to actuate the member to move from interfering orientation in the second opening.

10. The combination of claim 1 wherein the at least one member comprises a plurality of members disposed about the perimeter of the second opening, and further comprising means for urging the plurality of members generally into interfering orientation in the second opening when the shroud is in the second orientation.

11. The combination of claim 10 wherein the urging means comprises a plurality of springs for yieldably urging the plurality of members generally into interfering orientation in the second opening, the springs yielding to interference between the housing and the shroud as the shroud moves from the second orientation to the first to permit withdrawal of the plurality of members from interfering orientation in the second opening as the shroud moves from the second orientation toward the first orientation.

12. The combination of claim 11 further comprising a plurality of actuators, one actuator cooperating with each respective member and a corresponding spring to actuate the respective member to move from interfering orientation in the second opening.

13. The combination of claim 1 wherein the shroud lies generally between the atomizer and the atomizer housing.

14. The combination of claim 1 wherein the atomizer comprises a rotary atomizer, and further comprising a second prime mover for rotating the rotary atomizer to promote the dispensing of the coating material therefrom.

15. The combination of claim 1 wherein the atomizer comprises a metal atomizer.

16. The combination of claim 1 wherein the first prime mover comprises a linear fluid motor.

17. The combination of claim 1 wherein the atomizer housing comprises a first opening through which the atomizer dispenses coating material and the shroud comprises a corresponding second opening through which the atomizer dispenses coating material, the second opening generally surrounding the first when the shroud is in the first orientation.

18. The combination of claim 1 further comprising means for urging the at least one member generally into interfering orientation in the second opening when the shroud is in the second orientation.

19. The combination of claim 18 wherein the urging means comprises a spring for yieldably urging the member generally into interfering orientation in the second opening, the spring yielding to interference between the housing and the shroud as the shroud moves from the second orientation to the first to permit withdrawal of the member from interfering orientation in the second opening as the shroud moves from the second orientation toward the first orientation.

20. The combination of claim 19 further comprising an actuator cooperating with the member and the spring to actuate the member to move from interfering orientation in the second opening.

21. In combination, an atomizer having an electrically non-insulative charging portion, an atomizer housing, a selectively movable shroud, and a first prime mover for selectively moving the movable shroud relative to the charging portion, the shroud having a first, retracted orientation in which the shroud does not shield the charging portion from the approach of articles to the charging portion, in which retracted orientation of the shroud the atomizer dispenses coating material, the shroud further having a second, projected orientation in which the shroud shields the charging portion from the approach of articles to the charging portion, the atomizer housing comprising a first opening through which the atomizer dispenses coating material and the shroud comprising a corresponding second opening through which the atomizer dispenses coating material, the first opening generally surrounding the second when the shroud is in the first orientation.

22. The combination of claim 21 wherein the shroud lies generally between the atomizer and the atomizer housing.

23. The combination of claim 21 wherein the atomizer comprises a metal atomizer.

24. In combination, an atomizer having an electrically non-insulative charging portion, an atomizer housing, a selectively movable shroud, and a first prime mover for selectively moving the movable shroud relative to the charging portion, the shroud having a first, retracted orientation in which the shroud does not shield the charging portion from the approach of articles to the charging portion, in which retracted orientation of the shroud the atomizer dispenses coating material, the shroud further having a second, projected orientation in which the shroud shields the charging portion from the approach of articles to the charging portion, the shroud comprising a shroud inner wall and a shroud outer wall, at least one passageway extending generally in a non-intersecting orientation to the shroud inner and outer walls, and at least one resistance disposed in the at least one passageway, the at least one resistance having first and second terminals, the first and second terminals exposed from the shroud respectively at a forward end of the shroud and along the shroud inner wall adjacent the location of the atomizer when the shroud is in the second orientation.

25. The combination of claim 24 wherein the at least one resistance comprises at least one lumped resistor.

26. The combination of claim 24 wherein the at least one resistance comprises electrically non-insulative material provided in the at least one passageway.

27. The combination of claim 26 wherein the first prime mover comprises a fluid piston and cylinder.

28. The combination of claim 24 wherein the atomizer comprises a metal atomizer.

29. In combination, an atomizer having an electrically non-insulative charging portion, an atomizer housing, a selectively movable shroud, and a first prime mover for selectively moving the movable shroud relative to the charging portion, the shroud having a first, retracted orientation in which the shroud does not shield the charging portion from the approach of articles to the charging portion, in which retracted orientation of the shroud the atomizer dispenses coating material, the shroud further having a second, projected orientation in which the shroud shields the charging portion from the approach of articles to the charging portion, the shroud comprising a shroud inner wall and a shroud outer wall, at least one passageway extending generally within a space defined between the shroud inner and outer walls, and at least one resistance disposed in the at least one passageway, the at least one resistance having first and second terminals, the first and second terminals exposed from the shroud respectively at a forward end of the shroud and a location adjacent the location of the atomizer when the shroud is in the second orientation.

30. The combination of claim 29 wherein the at least one resistance comprises at least one lumped resistor.

31. The combination of claim 30 wherein the atomizer comprises a metal atomizer.

32. The combination of claim 29 wherein the at least one resistance comprises electrically non-insulative material provided in the at least one passageway.

33. The combination of claim 31 wherein the atomizer comprises a metal atomizer.

34. The combination of claim 29 wherein the atomizer comprises a metal atomizer.

* * * * *